US006926388B2

(12) United States Patent
Gröninger et al.

(10) Patent No.: US 6,926,388 B2
(45) Date of Patent: Aug. 9, 2005

(54) INKJET PRINTHEAD, A METHOD OF CONTROLLING AN INKJET PRINTHEAD, AND AN INKJET PRINTER PROVIDED WITH SUCH A PRINTHEAD

(75) Inventors: Mark Alexander Gröninger, Venlo (NL); Pieter Gijsbertus Maria Kruijt, Eindhoven (NL); Hans Reinten, Velden (NL); Ronald Herman Schippers, Venlo (NL); Johannes Mathieu Marie Simons, Venlo (NL)

(73) Assignee: Océ-Technologies B.V., Venlo (NL)

( * ) Notice: Subject to any disclaimer, the term of this patent is extended or adjusted under 35 U.S.C. 154(b) by 98 days.

(21) Appl. No.: 10/612,001

(22) Filed: Jul. 3, 2003

(65) Prior Publication Data

US 2004/0017412 A1 Jan. 29, 2004

(30) Foreign Application Priority Data

Jul. 5, 2002 (NL) ..... 1021015

(51) Int. Cl.[7] ..... B41J 2/04
(52) U.S. Cl. ..... 347/54; 347/19
(58) Field of Search ..... 347/9, 10, 14, 347/19, 54, 68–72; 310/316.1, 317, 328, 330

(56) References Cited

U.S. PATENT DOCUMENTS 4,498,088 A * 2/1985 Kanayama ..... 347/92
4,625,220 A * 11/1986 Nagashima ..... 347/19
4,743,924 A * 5/1988 Scardovi ..... 347/10
5,757,392 A 5/1998 Zhang
6,435,672 B1 * 8/2002 Groninger et al. ..... 347/69

FOREIGN PATENT DOCUMENTS

| | | |
|---|---|---|
| DE | 33 19 353 A1 | 11/1984 |
| EP | 0 221 703 A1 | 5/1987 |
| EP | 03146346 | 6/1991 |
| EP | 0 931 652 A2 | 7/1999 |
| EP | 0 988 973 A1 | 3/2000 |
| EP | 1 013 453 A2 | 6/2000 |

* cited by examiner

*Primary Examiner*—Anh T. N. Vo
(74) *Attorney, Agent, or Firm*—Birch, Stewart, Kolasch & Birch, LLP

(57) ABSTRACT

A method of controlling an inkjet printhead with a substantially closed duct in which ink is disposed, which duct has an exit opening for the ink, the method including the actuation of an electromechanical transducer so that the pressure the duct changes in such a manner that an ink drop is ejected from the exit opening, said pressure causing a deformation of the transducer, whereby after the end of the actuation, an electric signal generated by the transducer is measured as a result of the deformation, wherein a subsequent actuation of the transducer is adapted to the measured signal.

5 Claims, 5 Drawing Sheets

INKJET PRINTHEAD, A METHOD OF CONTROLLING AN INKJET PRINTHEAD, AND AN INKJET PRINTER PROVIDED WITH SUCH A PRINTHEAD

BACKGROUND OF THE INVENTION

This non-provisional application claims priority under 35 U.S.C. §119(a) on Patent Application No. 1021015 filed in The Netherlands on Jul. 5, 2002, which is herein incorporated by reference.

1. Field of the Invention

The present invention relates to a method of controlling an inkjet printhead with a substantially closed duct in which ink is present, said duct having an exit opening for the ink. The method includes the steps of actuating an electromechanical transducer so that the pressure in the duct changes in such a manner that an ink drop is ejected from the exit opening, the pressure causing a deformation of the transducer, and, after the end of the actuation, measuring the electrical signal generated by the transducer as a result of the deformation. The present invention also relates to an inkjet printhead suitable for applying the present method and an inkjet printer provided with such a printhead.

2. Background Art

A method of this kind is known from European patent application EP 1 013 453. In this method, the electromechanical transducer, a piezo-electric transducer in this specific case, is energised by applying a voltage or current in pulse form thereto via an actuation circuit. As a result of this energization, the transducer expands in the direction of the duct. As a result, pressure in the duct is suddenly raised. As a result of this pressure increase a drop of ink is ejected from the exit opening. After this drop has left the ink duct, there are, however, still residues of the original pressure wave present because the latter requires some time for a complete damping thereof. This residual pressure wave in turn deforms the piezo-electric transducer so that the latter generates an electric signal which can be measured as a current or voltage. This electric signal is dependent on the state of the duct. For example, if there is an air bubble present in the duct, the damping will be different from what occurs in the case of a completely full duct. Also, a fault in the printhead material around the duct, for example the detachment of a layer of glue between two parts, will also influence this electric signal. In the known process, the piezo-electric transducer is switched into a measuring circuit after the end of the actuation so that the electrical signal can be measured. By comparison with a reference signal, i.e. the signal generated by the transducer of a duct defined as normal, it is then possible to determine whether the duct is in good condition or whether there is a problem which may influence print quality. If a deviation is found, a repair action is carried out, for example flushing the ducts with clean ink. By exact analysis of the signal it is even possible to determine what specific problem has occurred so that a repair action directed towards that problem can be carried out. One example of this is the absence of a wiper for cleaning the front of the printhead, for example because it has broken off. Since the presence of such a wiper, if it cleans the exit side of an ink duct, is visible in the generated electric signal, its absence can also be recorded. In brief, using the known method, an ink duct, and anything in the printer which also determines the state in the ink duct, it is possible to continuously check for proper operation and make repairs if a problem occurs. In this way a permanently good print quality can be achieved.

The known method, however, has a number of significant disadvantages. Firstly, if a deviation of the electric signal is found, it will in most cases result in a repair action even if this is unnecessary or illogical. It is often expensive, because such an action relates, for example, to rinsing the printhead with clean ink or even replacing the entire printhead. This also affects productivity, because no receiving materials can be printed during the repair action. In addition, the known method has problems with compensating for changes which are small or occur gradually but which do influence the print quality. For example, as a result of ageing, the coefficient of expansion of the piezo-electric transducer can change slowly. Up to a specific threshold value, no repairs will be carried out in the known method while there may nevertheless be an appreciable influence on print quality. This disadvantage occurs, for example, even if the printhead is provided with new ink, i.e. ink from a different batch. If this ink were to give rise to another electric signal, something which is quite possible because the viscosity of the ink has a significant influence on the pressure curve in the duct, and said change is lower than the threshold value, then no action is taken while the print quality may well be influenced. If, however, the measured signal does differ from the reference signal sufficiently, then a repair action in principle is illogical because flushing with ink will not result in a different ink in the duct. In the known method, this problem can be compensated for by providing the printer, for example in the printhead, with sensors to measure all types of variables affecting the pressure build up in the ink duct, such as the above-mentioned ink viscosity. Depending on the measured value for one or more of these variables, then a different reference signal can be selected. The disadvantage of this, however, is that sensors must be incorporated in the inkjet printer. Sensors, however, are expensive and not always easy to implement. In addition, the number of sensors that can be used is limited, simply because there is frequently no room for a large number of sensors. Thus usually sensors are provided solely to measure the temperature of the printhead, the pressure in the ink duct and the level of the ink in an ink reservoir connected to the ink duct. Since there are many more variables which influence the pressure build-up in a duct as a result of actuation of the transducer, this known method provides only a limited solution of the above problems.

SUMMARY OF THE INVENTION

The object of the present invention is to obviate the above problems. To this end, a method has been invented, wherein a subsequent actuation of the transducer is adapted to the measured signal. This method recognizes that a specific deviation in the duct influences the actuation following on the occurrence of the deviation and therefore possibly the drop ejection process. In the method according to the present invention, this influence is compensated for by adapting the actuation to this deviation. The deviation is known because it is manifested in the measured signal. If, for example, a deviation has occurred which gives rise to a higher pressure in the duct, the actuation can be adapted by applying a lower voltage pulse. In this way, the net effect, for example reaching a specific pressure, is still the same. The method according to the present invention implies that it is known how a specific deviation is manifested in the measured signal. In EP 1 013 453, a number of examples is given of deviations manifested by a typical change in the measured signal. In the same way, simple experiments can investigate how small deviations are manifested. For example, in a normally functioning duct, the influence of the pressure in the duct, or the viscosity of the ink, or the temperature of the head, etc., on the signal can be determined by changing these parameters with small steps and determining the influence thereof on the measured signal. By processing this information in a model, it is possible to determine at all times in a functioning printer what deviation causes a change in the measured signal. Thus, actuation of the transducers can be adapted in order to compensate for this deviation while the printhead is in a printing mode for the image-wise printing of a receiving material. Whether such a deviation can be completely compensated for by adapting the actuation depends on the nature of the deviation. Deviations such as, for example, an interruption or short circuit in an electric circuit, or other disturbances in the electric circuits used for controlling the ink duct, for example supplies, ASICS, etc., which are often visible in the measured signal, will generally be difficult to compensate for if possible at all. Repair or replacement is then one possibility of solving this problem. Mechanical defects such as a crack in a wall of an ink duct can often be compensated for if they are not too great.

It is important that by using the method according to the present invention it is often unnecessary to carry out a repair action if a deviation is found. In many cases the deviation can be compensated for by adapting the actuation to said deviation. This not only saves costs, but also increases the printer productivity. The print quality is also improved because small deviations which in the known method would not result in a repair action but which may well have minor print deviations as a result, can be compensated for in simple manner. For example, if the printhead is provided with new ink the actuation can be easily adapted to said ink so that no noticeable print artefacts occur as a result of other properties of this ink. Repair action is, in this case, superfluous. Other changes which influence the drop ejection process can readily be found because all of these changes appear in the electric signal generated by the transducer after the end of a previous actuation. Changes in temperature, negative pressure in the printhead, coefficient of expansion of the transducer, etc., have an influence on the measured signal so that they can be compensated for. As a result, there is no longer any need to provide the printhead with all kinds of sensors in order to measure these and possible other variables. Simply because changes in these variables are manifested in a change in the measured signal, such changes can be taken into account in determining the final actuation pulse.

In one embodiment, the following actuation is equal to a standard actuation if the measured electric signal satisfies a predetermined standard. This embodiment of the method according to the present invention is advantageous because very small fluctuations in the electric signal often occur without this having a noticeable effect on the final print quality. If an adapted actuation has to be determined for each deviation, this would require excessive occupation of the available computing time in a processor of the printer. To obviate this, it is possible to define a standard within which deviations are permissible without this resulting in adaptation of the actuation. This standard depends, for example, on the user's wishes and/or the range of application of the method. If the method is used, for example, in an area where very high requirements are applied in respect of print quality, the standard will be different from the case in which specific visible print artefacts are tolerated.

In another embodiment, analysis of the measured signal enables a value to be determined for the electromechanical coefficient of expansion of the transducer, and/or a negative pressure in the ink duct, and/or the ink level in an ink reservoir connected to the ink duct, and/or the viscosity of the ink, and/or the temperature of the ink, and/or the temperature of the transducer. In this embodiment, not only is a deviation compensated for by adapting the actuation to said deviation, but a value of one or more of the above variables is also determined. In fact, in a number of cases it is advantageous to determine the value of specific variables because this may be relevant information for an adequate use of the printer. These variables can be determined by measuring the electric signal because all these variables influence this signal. As an example, if during servicing it is found that the coefficient of expansion (expansion in meters per volt of actuation voltage) of a large number of transducers is below a specific value, it would be reasonable to replace the entire printhead, even if the deviant coefficient of expansion does not yet influence the drop ejection process (the deviation can of course be compensated for by using the method according to the present invention). Replacement would be advantageous, for example, if a deviation of this kind indicates a general ageing of the printhead which will rapidly be followed by early breakdown of the entire printhead. To avoid the service engineer for having to return for this purpose within a short period, it may be decided to replace the entire printhead as a preventative measure. In the same way, a specific deviation of the (negative) pressure in the printhead may indicate deviations in the negative pressure system, for example ink feed hoses or vacuum hoses may have become porous. Since the value of the deviation is determined, it is possible to assess whether maintenance is necessary with respect to the negative pressure system. The ink level in an ink reservoir in fluid communication with the ink duct could be used to determine when said reservoir should be replenished. The reason that this level can be determined is because the pressure waves in the duct, dependent upon the geometry of the printhead, are propagated to the ink reservoir where they are reflected against the ink surface. This effect is manifested in the measured signal so that a value for the ink level in the reservoir can be determined.

In the event of deviations of the ink viscosity (or often: the viscosity at a specific temperature, in this case the temperature-dependent viscosity curve), all of these can be compensated for by applying the method according to the present invention, and the absolute value of the viscosity can yield significant information. Thus a deviant viscosity can indicate a wrong ink which probably, in the event of long-term use, will lead to irreparable problems, such as clogging of the ducts or detachment of glue connections in the printhead. The wrong ink can be replaced by the correct ink by early detection thereof. Determining the viscosity could also be used to keep the temperature of the ink during a stand-by period just high enough for the ink still to be fluid. This prevents energy waste without delaying the start-up time from stand-by for a long period.

Measuring the actual temperature of the ink or the transducer is important because the entire drop ejection process may depend on these variables. The temperature of the ink is in fact of considerable significance for the physical properties of the ink, particularly the ink viscosity. The temperature of the transducer is important for the properties of said transducer, particularly the expansion of said transducer as a function of the voltage.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
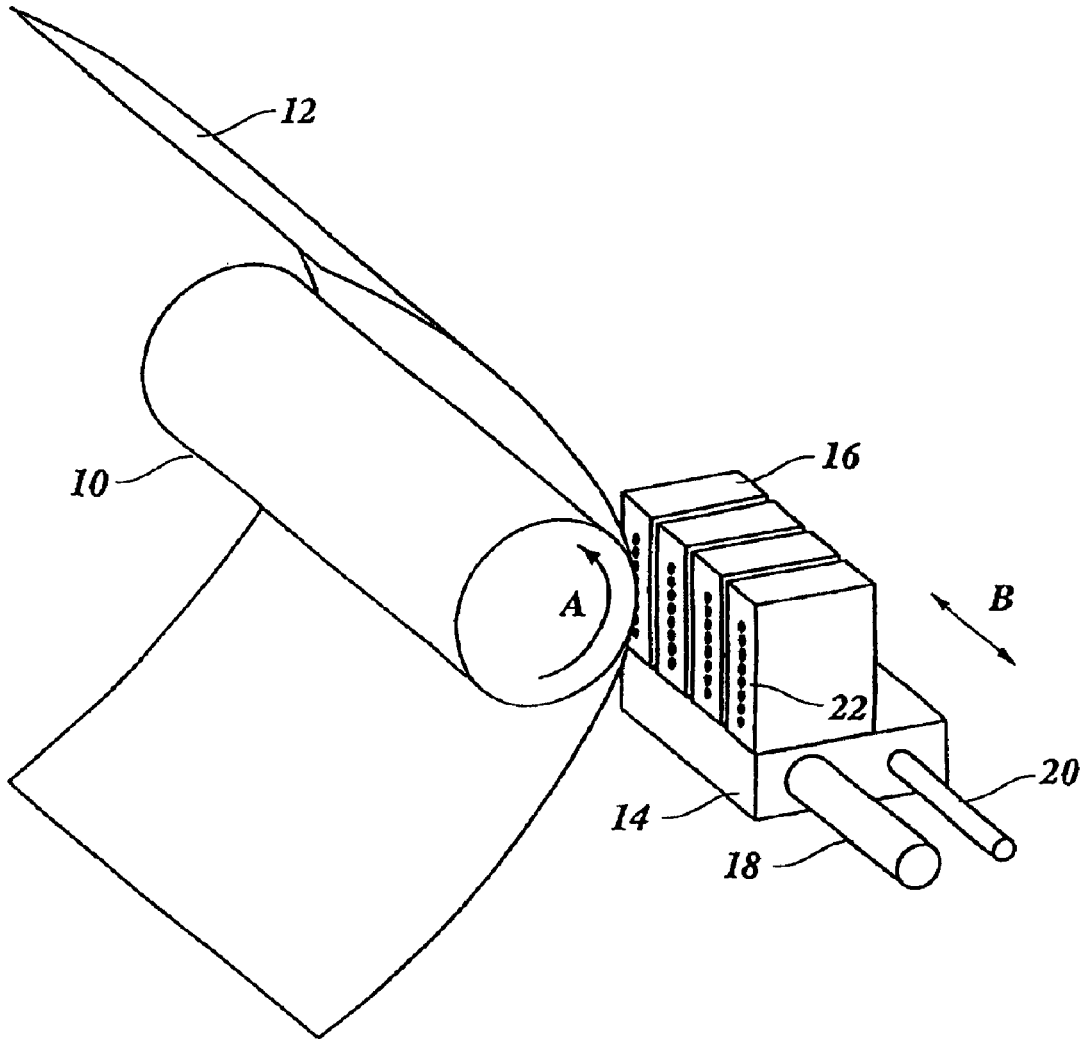
FIG. 1 is a diagram of an inkjet printer.

FIG. 1 diagrammatically illustrates an inkjet printer. In this embodiment, the printer comprises a roller 10 to support a receiving medium 12 and move it along the four printheads 16. The roller 10 is rotatable about its axis as indicated by arrow A. A carriage 14 carries the four printheads 16, one for each of the colors cyan, magenta, yellow and black, and can be moved in reciprocation in a direction indicated by the double arrow B, parallel to the roller 10. In this way the printheads 16 can scan the receiving medium 12. The carriage 14 is guided on rods 18 and 20 and is driven by suitable means (not shown).

In the embodiment as shown in the drawing, each printhead 16 comprises eight ink ducts, each with its own exit opening 22, which form an imaginary line perpendicular to the axis of the roller 10. In a practical embodiment of a printing apparatus, the number of ink ducts per printhead 16 is many times greater. Each ink duct is provided with a piezo-electric transducer (not shown) and associated actuation and measuring circuit (not shown) as described in connection with FIGS. 2 and 3. Each of the printheads also contains a control unit for adapting the actuation pulses. In this way, the ink duct, transducer, actuation circuit, measuring circuit and control unit form a system serving to eject ink drops in the direction of the roller 10. It is not essential for the control unit and/or for example all the elements of the actuation and measuring circuit to be physically incorporated in the actual printheads 16. It is also possible for these parts to be located, for example, in the carriage 14 or even a more remote part of the printer, there being connections to components in the printheads 16 themselves. In this way, these parts nevertheless form a functional part of the printheads without actually being physically incorporated therein. If the transducers are actuated image-wise, an image forms which is built up of individual ink drops on the receiving medium 12.

Figure 2:
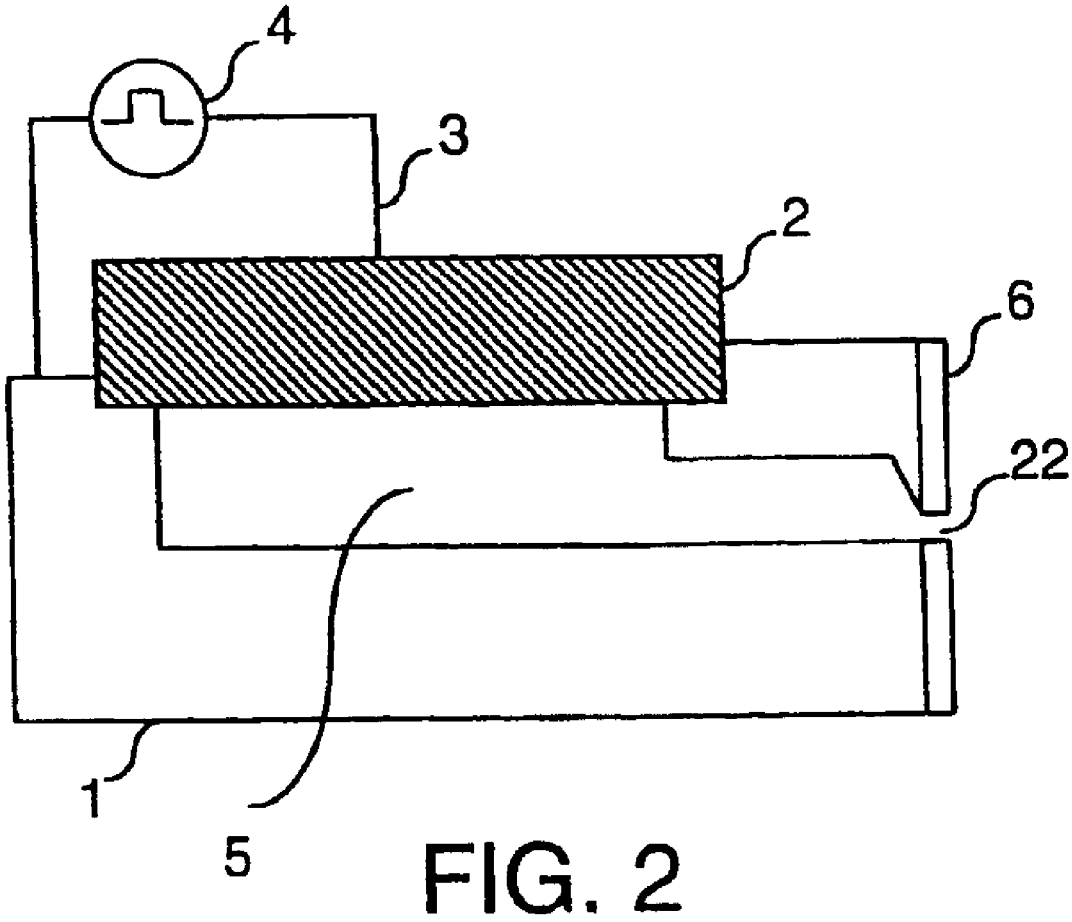
FIG. 2 is a diagram of parts of the inkjet printhead.

In FIG. 2, an ink duct 5 is provided with an electromechanical transducer 2, in this example a piezo-electric transducer. Ink duct 5 is formed by a groove in baseplate 1 and at the top is bounded mainly by the piezo-electric transducer 2. Ink duct 5 merges at the end into an exit opening 22 formed by a nozzle plate 6 in which a recess is made at the location of the duct. When a pulse is applied across transducer 2 by a pulse generator 4 via the actuation circuit 3, transducer 2 bends in the direction of the duct so that the pressure in the duct is suddenly increased whereby an ink drop is ejected from the exit opening 22. After the end of the drop ejection, a pressure wave is still present in the duct and decays after a lapse of time. This wave in turn results in a deformation of the transducer 2 which generates an electric signal in response thereto. This signal is dependent on all the parameters influencing the formation of the pressure wave and the damping of said wave. In this way, information concerning these parameters can be obtained by measuring this signal. This information can in turn be used to adapt the printing process, particularly the subsequent actuation or actuations.

Figure 3:
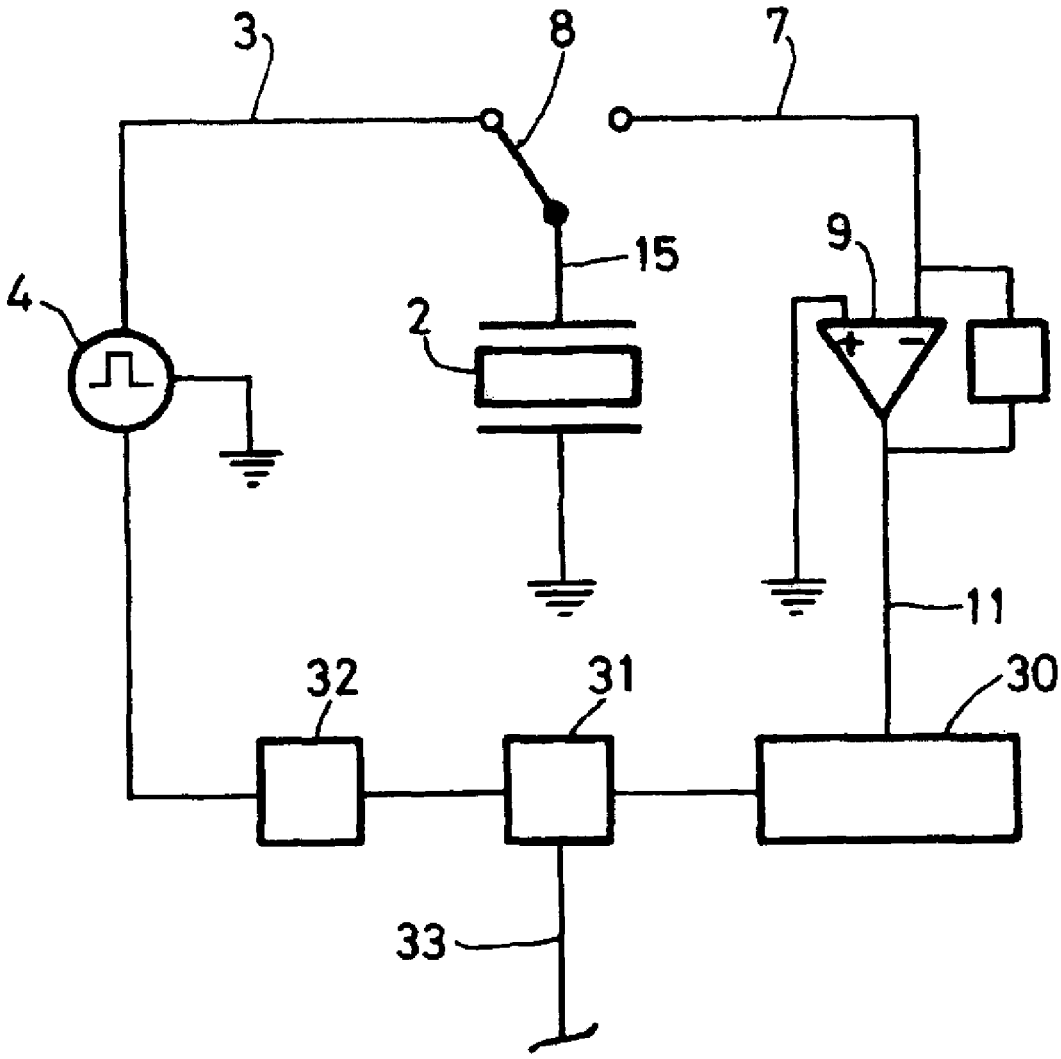
FIG. 3 is a diagram showing an electric circuit suitable for use in the method according to the present invention.

FIG. 3 is a block schematic of the piezo-electric transducer 2, the actuation circuit (elements 3, 8, 15, 2 and 4), the measuring circuit (elements 2, 15, 8, 7 and 9) and control unit 31 in a preferred embodiment. The actuation circuit, provided with the pulse generator 4, and the measuring circuit, provided with amplifier 9, are connected to transducer 2 via a common line 15. The circuits are interrupted and closed by changeover switch 8. After a pulse has been applied across transducer 2 by the pulse generator 4, the transducer 2 is in turn deformed by the resulting pressure wave in the ink duct. This deformation is converted to an electric signal by transducer 2. After the expiration of the actual actuation of the transducer, the changeover switch 8 is shifted so that the actuation circuit is interrupted and the measuring circuit closed. The electric signal generated by the transducer is received by amplifier 9 via line 7. In this embodiment, the accompanying voltage is fed via line 11 to A/D converter 30, which feeds the signal to control unit 31. Here the measured signal is subjected to analysis. If necessary, a signal is delivered to pulse generator 4 via D/A converter 32 so that a following actuation pulse can be adapted. Control unit 31 is connected to the central processor of the printer (not shown) via line 33. In this way information can be exchanged with the rest of the printer and/or the exterior.

Figure 4A:
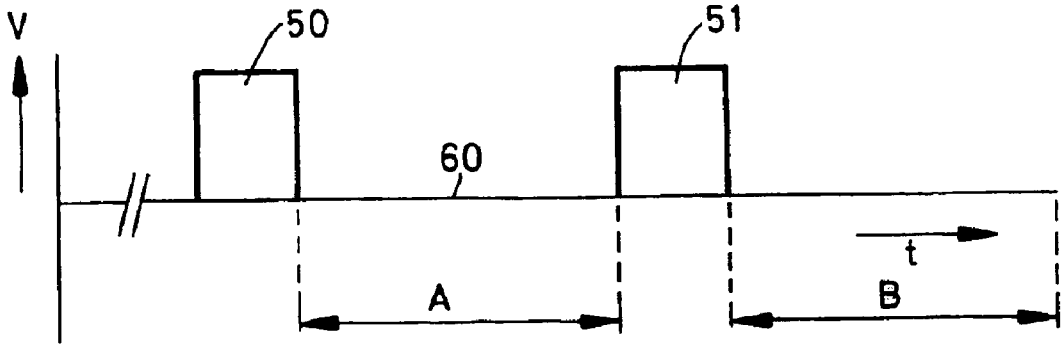
FIG. 4 shows a number of actuation pulses and the measured electric signal in response thereto of a piezo-electric transducer.
Figure 4B:
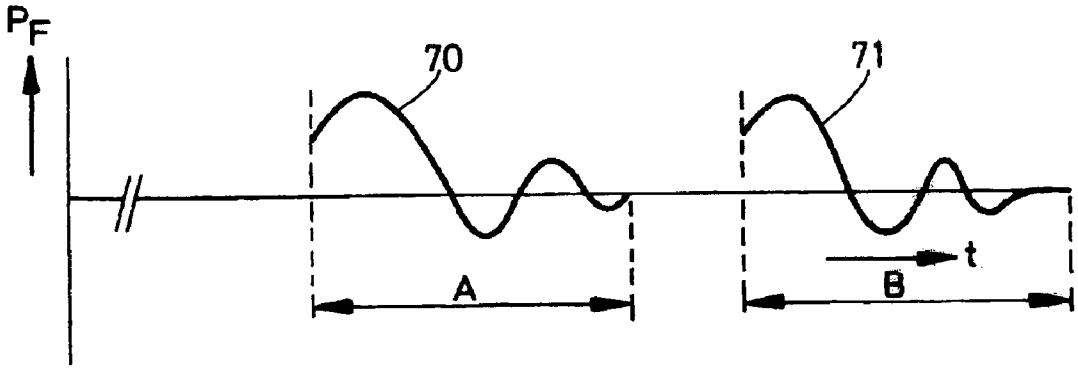

FIG. 4 diagrammatically illustrates a number of actuation pulses for an ink duct (FIG. 4*a*) and the resulting pressure change in said ink duct (FIG. 4*b*).

In FIG. 4*a*, the applied voltage V is plotted (in arbitrary units) against the time t (in arbitrary units). An actuation pulse 50 is indicated in the form of a block voltage, said pulse being directed at achieving a specific pressure in the duct at a specific moment so that a correct drop of ink is ejected at the correct time. As soon as the actuation pulse has finished, time interval A starts during which the transducer is no longer actuated (indicated by 60) but rather just the response of said actuation is measured by the piezo-electric transducer as a sensor for the use of this response (as explained in connection with FIG. 3). After the end of this period A an actuation 51 follows, which is directed at a following drop ejection. In this embodiment, after the end of this actuation, the measuring period B is started to measure the response of actuation 51.

FIG. 4*b* shows the effect of the above-described actuation pulses on the pressure in the associated ink duct. For this purpose, the pressure $P_F$ is plotted (in arbitrary units) against the time t (arbitrary units). The pressure $P_F$ is a fictitious pressure. The pressure itself in fact cannot be directly measured. The transducer generates an electric signal, for example a voltage, which is directly related to the pressure. This voltage is equated to the fictitious pressure $P_F$ in the duct in arbitrary units. This pressure is measured in the periods A and B, measuring periods which follow directly on the actuation of the transducer. Immediately after the start of the period A, the pressure $P_F$ in the duct is practically at a maximum as indicated by curve 70. Inter alia, depending on the geometry of the ink duct, a drop of ink will be ejected from the exit opening of the duct at around the time that this maximum pressure is reached. Thereafter the pressure drops as indicated. After the end of the entire period A the pressure is practically damped to the initial value. The duct is then in a state suitable for generating a following or subsequent drop ejection. Since there are no deviations, the next actuation 51 results in the same pressure curve as indicated by curve 71.

Figure 5A:
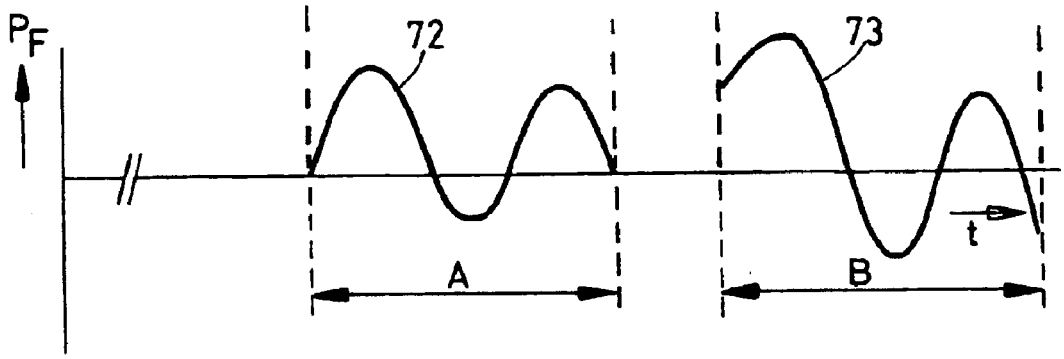
FIG. 5 diagrammatically illustrates an electric signal as measured in the event of a deviation in an ink duct and the actuation pulse to compensate for this deviation.
Figure 5B:
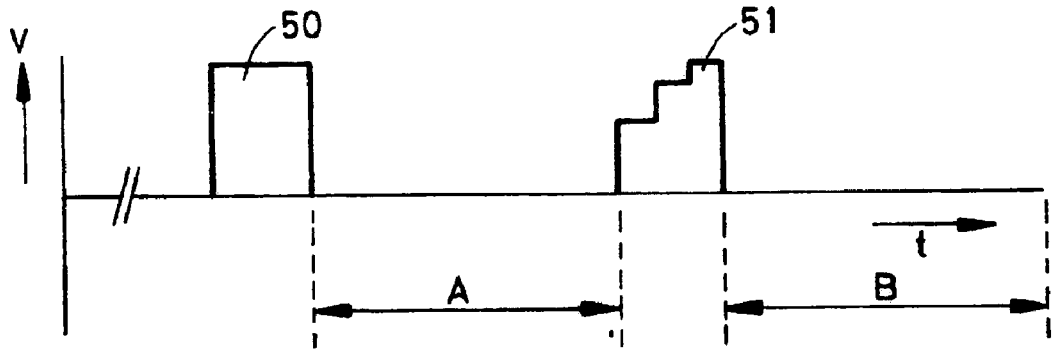

FIG. 5 shows a deviant pressure change (FIG. 5*a*) and an actuation pulse adapted to compensate for a deviant pressure change of this kind (FIG. 5*b*).

In FIG. 5*a*, as in FIG. 4*b*, a pressure change is shown in an ink duct as a result of an applied actuation pulse prior to the measuring period A. In this case the pulse results in a pressure curve 72 which is damped only with considerable inertia. The reason for this may, for example, be ageing of the material of the printhead. A curve of this kind means that at the end of period A the pressure is still sufficiently high noticeably to disturb the effect of a following actuation pulse. This is indicated by curve 73, which is the pressure change if a following actuation pulse is given which is equal to pulse 51 in FIG. 4*a*. This pressure change is such that the maximum pressure attained is much higher than required so that, for example, the drop of ink ejected from the exit opening is much too large.

To obviate such a pressure change, the pulse can be adapted as described in connection with FIG. 3. In this case, for example, this could result in an actuation pulse as shown in FIG. 5*b*. This actuation pulse 51' is adapted to the measured signal. The adapted pulse starts with a lower voltage and slowly rises in two steps. This block voltage will also result in a maximum pressure equal to that according to curve 71 in FIG. 4*b*, in the case of the present deviation. In this special case, the adapted pulse itself results in a pressure curve as indicated in FIG. 4*b* so that overall no influence of the deviation is perceived.

The present invention can also be used to compensate for tolerances between ducts mutually. If an analysis is made of the signals of each of the ducts of a printhead, often many hundreds for a typical inkjet head, the differences between the ducts will be readily visible. These mutual differences, although each duct of itself functions within the specifications, could be compensated in order to achieve an even better print quality. In one embodiment, such a blueprint or fingerprint of an entire printhead is made at regular intervals, for example during a service call. A fingerprint of this kind could of course also be used for other purposes, for example to fix production quality or identify a printhead.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A method of controlling an inkjet printhead with a substantially closed duct in which ink is situated, said duct having an exit opening for the ink, which comprises:

actuating an electromechanical transducer so that the pressure in the duct changes in such a manner that an ink drop is ejected from the exit opening, said pressure causing a deformation of the transducer, and after the end of the actuation, measuring an electric signal generated by the transducer as a result of said deformation, wherein a subsequent actuation of the transducer is adapted to the measured signal, while the printhead is in a printing mode for image-wise printing of a receiving material.

2. The method according to claim 1, wherein by analyzing of the measured signal it is possible to determine a value for the electromechanical coefficient of expansion of the transducer, a negative pressure in the ink duct, the ink level in an ink reservoir connected to the ink duct, the viscosity of the ink, the temperature of the ink, the temperature of the transducer.

3. An inkjet printhead which contains a substantially closed ink duct for holding ink, said duct having an exit opening for the ink, said printhead further comprising:

an actuation circuit for actuating an electromechanical transducer in such a manner that the pressure in the duct changes so that an ink drop can be ejected from the exit opening, the pressure change causing a deformation of the transducer, and a measuring circuit for measuring, after the end of the actuation, an electric signal generated by the transducer as a result of the deformation, wherein the printhead contains a control unit to adapt a subsequent actuation of the transducer to the measured signal.

4. An inkjet printer provided with a printhead according to claim 3.

5. The inkjet printhead of claim 3, wherein the actuation circuit comprises a pulse generator communicating with the transducer through a switch and the measuring circuit comprises the control unit communicating with said transducer through said switch.

* * * * *